United States Patent [19]

Flye et al.

[11] 4,413,365

[45] Nov. 8, 1983

[54] SAFETY LATCH FOR CRIB DROP SIDE

[75] Inventors: Donald R. Flye, Athol; Richard T. Heininger, Gardner, both of Mass.

[73] Assignee: Gem Industries, Inc., Gardner, Mass.

[21] Appl. No.: 308,984

[22] Filed: Oct. 6, 1981

[51] Int. Cl.[3] ..... A47D 7/02

[52] U.S. Cl. ..... 5/100; 5/425

[58] Field of Search ..... 5/100, 425, 429; 292/305, 306

[56] References Cited

U.S. PATENT DOCUMENTS

| | | | |
|---|---|---|---|
| 687,431 | 11/1901 | Kimball | 292/306 |
| 737,039 | 8/1903 | Stone | 292/306 |
| 1,505,220 | 8/1924 | Shay | 5/100 |
| 1,824,905 | 9/1931 | Kusferle | 5/100 |
| 2,522,001 | 9/1950 | Siegel et al. | 5/100 |
| 2,738,522 | 3/1956 | Kesler | 5/100 |
| 3,911,510 | 10/1975 | Bryant | 5/100 |

*Primary Examiner*—Ramon S. Britts
*Assistant Examiner*—Michael F. Trettel
*Attorney, Agent, or Firm*—Charles R. Fay

[57] ABSTRACT

A safety latch for a crib drop side and a notched drop rod including a clip on the top rail of the drop side, the clip having a part lodged in the notch when latched, the clip having a motion to unlatch the same only upon a relative motion of the rail with respect to the clip.

10 Claims, 6 Drawing Figures

SAFETY LATCH FOR CRIB DROP SIDE

BACKGROUND OF THE INVENTION

Crib drop sides should have mechanisms which the occupant cannot actuate so as to drop the drop side of the crib accidentally and it is the object of the present invention to provide such a childproof lock which is simple in structure, inexpensive to manufacture, and yet prevents the occupant from accidentally letting the drop side fall.

SUMMARY OF THE INVENTION

In general, the crib on the drop side as well as the drop rod on which the drop side slides may be substantially conventional. The drop side rod is secured to a corner post and has a notch at the side thereof facing the interior of the crib. The rod is vertical and extends through the upper horizontal rail of the drop side adjacent to the end thereof. There is a drop rod at each end of the crib. A generally U-shaped clip with end flanges and having an open side partly encompasses the rail and the clip flanges are apertured to accept the rod with one flange having an edge in the notch. The clip is provided with an inset portion at the lower flange thereof against which the horizontal rail rests in normal latched position of the drop side. This inset prevents inward motion of the clip, but the rail has a width less than the distance between the flanges of the clip and can be raised to avoid the inset, whereupon the clip can be moved relatively inwardly to release the flange from the notch. It is necessary to release both of these clips in order to allow the drop side to drop.

In order to release this catch, the entire drop side has to be raised slightly against the action of the spring and toward the upper one of the two clip flanges, FIGS. 3 and 5. In this position, the rail is free and clear of the inset so that the clip is capable of being given an inward motion by the operator, releasing the lower flange of the clip from the notch. Then the drop side will fall by gravity if manually released. However, when the rail is latched, this action cannot take place because of the fact that the inset engages the rail, preventing the clip from being biased inwardly, toward the interior of the crib. To re-latch the drop side, it is merely necessary to raise it.

There is a U-shaped clip of the kind described and a notch for the drop rod at the opposite end of the crib.

PREFERRED EMBODIMENT OF THE INVENTION

Figure 1:
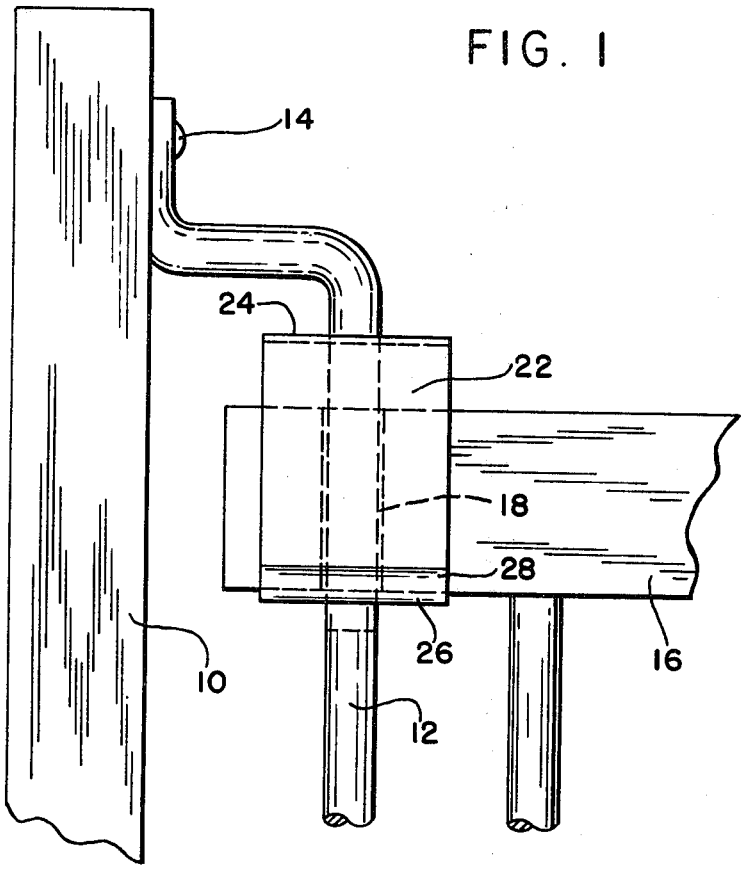
FIG. 1 is a view in front elevation illustrating the invention.

The novel construction herein described is shown at one end of the crib drop side but it is to be understood that there is a like structure at the opposite end of the drop side requiring that both ends be actuated in order to allow complete release of the drop side to let it drop.

The reference numeral 10 indicates a crib corner post and a drop rod 12 is shown as fastened at 14 with respect to the corner post 10. The drop rod 12 slidingly guides the drop side itself of which the upper horizontal rail 16 is provided with a bore 18 therein for sliding on the drop rod 12.

At its inner aspect facing the interior of the crib, there is a notch 20 on the drop rod, and a generally U-shaped clip generally indicated at 22 and having a pair of spaced flanges 24 and 26, which are apertured to receive the drop rod encompasses the horizontal rail 16. The vertical dimension of the rail is less than the distance between the flanges. This clip also has an inset portion adjacent lower flange 26 as at 28.

Figure 2:
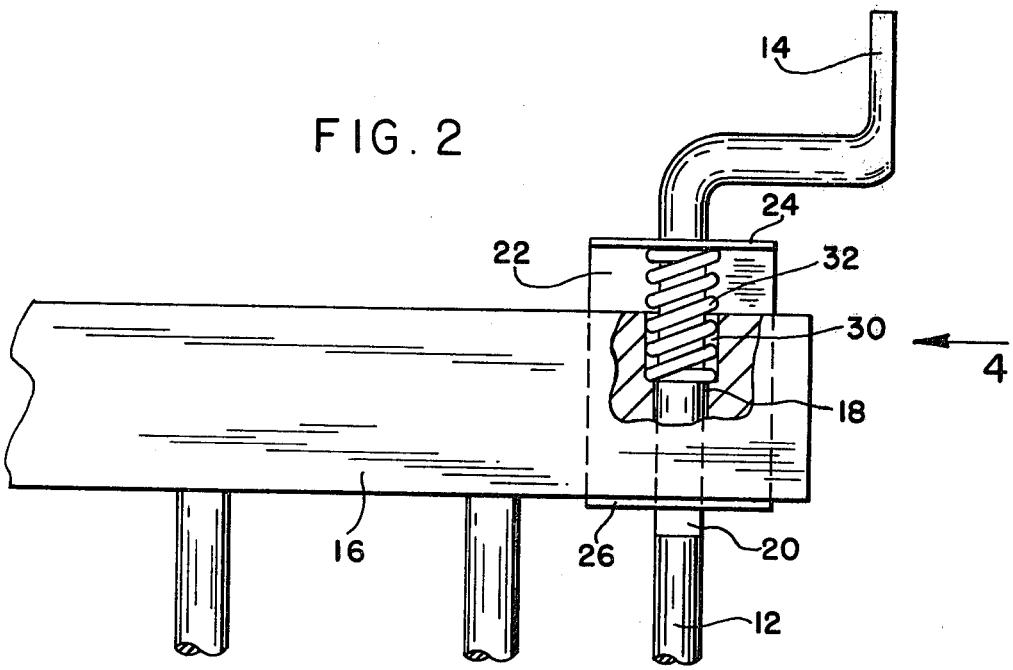
FIG. 2 is a rear view thereof with parts in section and showing the crib drop side in raised latched position.
Figure 3:
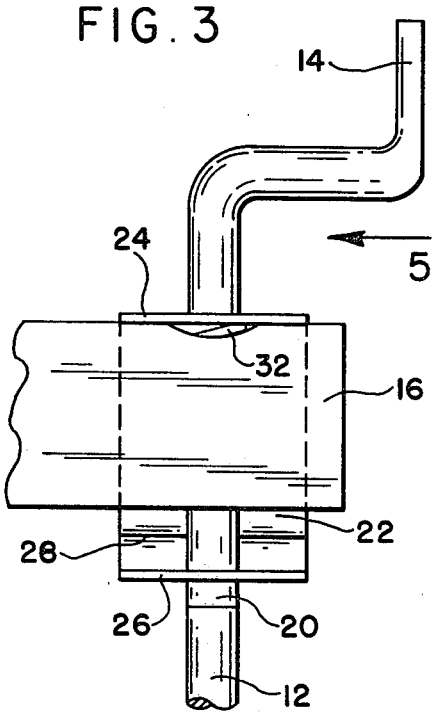
FIG. 3 is a view similar to FIG. 2 but showing the crib drop side raised sufficiently to allow actuation of the release.
Figure 4:
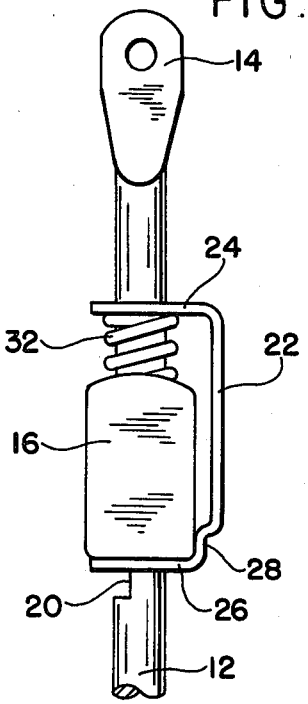
FIG. 4 is an end view looking in the direction of arrow 4 in FIG. 2.
Figure 6:
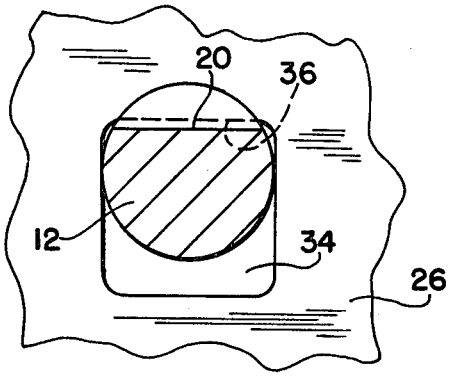
FIG. 6 is an enlarged detail illustrating the latching and unlatching positions of the locking clip relative to the crib drop side rod.

The bore 18 in the rail 16 has an enlargement 30 holding a coil spring 32 through which the drop rod extends, this spring holding the clip so that an edge 36 of aperture 38 in flange 26 is held in notch 20, see FIG. 6, thereby latching the drop side, FIGS. 2 and 4. The spring tends to bias the clip to this latched condition, and the rail 16 is in substantial contact with the inset 28, stabilizing the parts against accidental release.

A slightly enlarged portion 30 in bore 18 serves to hold a coil spring 32 which bears generally speaking on the rail 16 at the upper edge thereof and at the lower surface of flange 24 of the clip 22.

As shown in FIGS. 1, 2 and 4, the drop side of the crib is in normal raised and latched position. In this case, the rail 16 is located in close or contacting relation with respect to the inside aspect of the inset 28, see FIG. 4, preventing any relative horizontal motion of clip or rail. The clip flange 26 has an opening 34, FIG. 6, to accommodate the drop rod 12, and in the FIG. 4 position this opening has an edge as at 36 which is located in notch 20, thus holding the drop side in the upper position.

Figure 5:
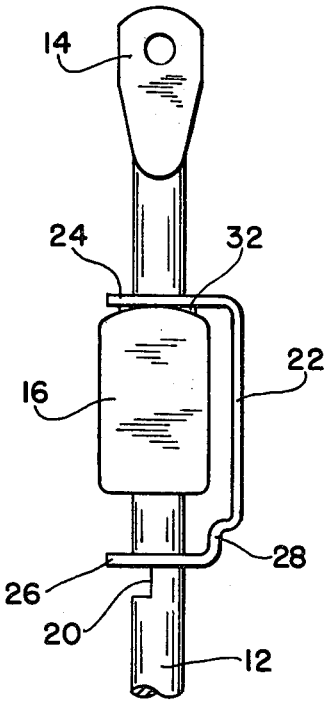
FIG. 5 is a view similar to FIG. 4 showing an end view looking in the direction of arrow 5 in FIG. 3.

In order to release the drop side, it is necessary to pull up on the drop side so that the rail assumes an uppermost position within the clip 22, but still latched by notch 20, see FIG. 5. In this position, the offset 28 of the clip is cleared by the rail providing a space between the clip and rail, so that the clip itself may be pushed, i.e., to the left in the direction of the arrow in FIG. 5. As shown in latched position in FIG. 4 the clip cannot be so pushed. With the rail in the FIG. 5 position, this will release flange 26 from the notch so that the drop side tends to drop by gravity. Flange 26 slides down over notch 20 because of the finger pressure on the clip urging it inwardly, and the drop side will be dropped to whatever conventional support may be found for the bottom horizontal rail of the drop side.

This action is shown in FIG. 6 wherein the edge 36 of the hole 34 in flange 26 of clip 22, is located in the notch 20, and the parts are held here in normal position by reason of the gravity acting on the entire drop side of the crib, but when the rail 16 is pushed upward manually into the FIG. 5 position and pressure in the direction of the arrows in FIGS. 5 and 6 releases the clip from the notch 20 so that the drop side may be lowered.

It will be seen that a double action is necessary and that it takes two hands spread the length of the drop side to release it; whereas, as shown in FIG. 4, the clip 22 cannot be moved to a releasing position by reason of the fact that the inset 28 engages against the outside surface of the rail 16 preventing any motion of the clip 22 toward releasing position. The spring 32 has a kind of bias action on the clip so that the clip can only be deliberately released by pressure in the direction of the arrows.

We claim:

1. In a crib having a drop side, a drop side rod on which the drop side is sidable, and said drop side includes a top horizontal rail having an opening through which the drop side rod extends, and means forming a notch in said drop side rod, a clip generally embracing said top rail, said clip including two generally parallel flanges apertured to receive the drop side rod, an inset in said clip adjacent one of said flanges, and a spring located on the top rail and bearing on the other of said flanges, the one flange adjacent the inset having a portion thereof generally bearing on the rod, said spring tending to bias the clip causing said portion to enter the notch, the flanges on the clip being spaced apart a distance greater than the height of the top rail so that the top rail is capable of motion in said clip between flanges, and in one position it is engaged by said inset and in another position it is free of the inset, in which position the clip can be moved to remove the portion of said one flange from the notch whereby the drop side may be lowered.

2. The crib of claim 1 wherein the motion of the clip to free the one flange from the notch is transverse to the motion of the top rail relative to the flanges of the clip.

3. The crib of claim 2 wherein the notch in the drop rod is located at the side of the rod facing the interior of the crib.

4. The crib of claim 1 wherein an edge of the aperture in said one flange comprises the portion thereof that enters the flange.

5. The crib of claim 1 including a like drop rod remote from the first named drop rod, and a like latch structure associated with the second named drop rod.

6. In child's furniture including a drop side, a cooperating drop rod therefor, a notch in the rod, and a top rail on the drop side, a clip generally embracing the rail, said clip including a pair of generally parallel apertured parts, the rod passing through the apertures and rail, wherein the clip parts are spaced apart a distance greater than the width of the rail between the parts, said clip including means to inhibit motion of the clip transverse to the rod with the rail in one position but allowing such motion in another position thereof, one part of the clip being held in the notch with the clip in motion inhibited position, and being movable to free the notch in the other position.

7. The crib of claim 6 including resiliant means tending to bias the clip to a position wherein the one clip part tends to enter the notch.

8. The crib of claim 7 wherein the motion of the rail between the parts of the clip is along the rod and the motion of the clip to free the notch is transverse thereto.

9. The crib of claim 7 wherein the notch faces the interior of the crib and the clip motion to free the notch is inwardly of the crib, the one part of the clip engaging the notch residing in an edge of the aperture in the clip part.

10. The crib of claim 6 wherein the clip motion inhibiting means includes an inset in the clip adjacent to one of the clip parts.

* * * * *